United States Patent [19]

de la Bretonière

[11] Patent Number: 4,538,054

[45] **Date of Patent: * Aug. 27, 1985**

[54] ELECTRIC HEATING FABRIC

[76] Inventor: André B. de la Bretonière, Beethovenlaan 29, Doorwerth, Netherlands

[ * ] Notice: The portion of the term of this patent subsequent to Mar. 23, 1993 has been disclaimed.

[21] Appl. No.: 564,780

[22] Filed: Dec. 27, 1983

Related U.S. Application Data

[63] Continuation of Ser. No. 252,735, Apr. 10, 1981, abandoned, which is a continuation of Ser. No. 21,130, Mar. 16, 1979, abandoned, which is a continuation-in-part of Ser. No. 743,750, Nov. 22, 1976, abandoned, which is a continuation-in-part of Ser. No. 523,731, Nov. 14, 1974, abandoned.

[30] Foreign Application Priority Data

Nov. 14, 1973 [NL] Netherlands ..... 7315574

[51] Int. Cl.[3] ..... H05B 3/34

[52] U.S. Cl. ..... 219/545; 219/529; 219/212; 219/345; 219/549; 338/208; 338/212

[58] Field of Search ..... 219/211, 212, 345, 213, 219/437, 228, 521, 527, 528, 529, 535, 545, 548, 549, 553; 338/208, 209, 210, 211, 212

[56] References Cited

U.S. PATENT DOCUMENTS

| | | | |
|---|---|---|---|
| 1,036,632 | 8/1912 | Jahr | 219/545 X |
| 1,869,629 | 8/1932 | Stranszky | 219/545 X |
| 2,327,756 | 8/1943 | Adamson | 219/545 |
| 2,678,993 | 5/1954 | DeBoer | 219/545 X |
| 3,060,303 | 10/1962 | Scoglund et al. | 219/549 |
| 3,290,807 | 12/1966 | Esaka | 219/545 X |
| 3,349,359 | 10/1967 | Morey | 338/208 |
| 3,425,020 | 1/1969 | Toyooka et al. | 338/208 |
| 3,513,297 | 5/1970 | Jordan | 219/545 |
| 3,721,799 | 3/1973 | Carlstrom | 219/212 |
| 3,946,194 | 3/1976 | Bretoniere | 219/545 X |

FOREIGN PATENT DOCUMENTS

| | | | |
|---|---|---|---|
| 253525 | 6/1927 | Italy | 219/545 |
| 553804 | 6/1943 | United Kingdom | 219/545 |

*Primary Examiner*—Volodymyr Y. Mayewsky
*Attorney, Agent, or Firm*—William A. Drucker

[57] ABSTRACT

An electrical heating fabric has a warp composed of non-conductive threads, and selvedges which include plural lead wires. In the weft direction the fabric has both non-conductive threads and conductive wires. The different types of weft material are arranged in successive strips disposed transversely to the warp. First strips have non-conductive weft threads only. Second strips additionally have conductive weft wires. The strips are arranged alternately. The weft wires are all discrete, and their two ends are either in simple contact with the selvedge lead wires or are interwoven therewith.

6 Claims, 2 Drawing Figures

ELECTRIC HEATING FABRIC

This application is a continuation of Ser. No. 252,735, filed Apr. 10, 1981 (now abandoned), which was a continuation of Ser. No. 21,130, filed Mar. 16, 1979 (now abandoned), which was a continuation-in-part of Ser. No. 743,750, filed Nov. 22, 1976 (now abandoned), which was a continuation-in-part of Ser. No. 523,731, filed Nov. 14, 1974 (now abandoned), which claimed priority from Netherlands Application No. 7315574, filed Nov. 14, 1973.

BACKGROUND OF THE INVENTION

This invention relates to an electric heating fabric having opposed selvedges, said fabric being provided with electrically conductive lead wires of which at least one is arranged in each of said selvedges.

For heating large areas, such as frozen ground or runways, the method generally used hitherto is to heat air or water locally using conventional heaters. The air or water is then supposed to transport heat to the entire area and to transfer heat to its surface. This method may be called "indirectly heating a large area by means of convection".

It is however advantageous to provide a method for "directly heating" areas by means of "generated heating power", making use of the phenomenon that electric power is converted into heating power inside electrically conductive material if it is connected to a current source, and that this heating power becomes available at its outside surface area.

If such a heating element is available, the user has to know its electrical resistance, in order to establish its heating power in connection with the voltage to be used, and has to know also the size of its surface area in order to calculate the "density of power" for heating for establishing its temperature rise. He therefore has to know also the numerical relationship between power density, temperature rise and the thermal resistance value of its environment given by the so-called "thermal law of Ohm".

It is generally a problem to manufacture a heating element having the required size and resistance as well as the desired voltage rating. This problem is solved by the invention not only for heating large areas but also for manufacturing smaller heating elements for apparatus needing such heating elements.

The heating element of the invention can be mass produced, enabling the user to determine its size and obtaining the resistance as required, and subsequently to establish the heating power required, and its temperature rise as well enabling him to control its heating temperature accurately.

Electric heating elements having electrically conductive heating wires therein are known from the U.S. Pat. No. 3,060,303. Said known heating elements may be made with a predetermined heating capacity by molding under pressure and heat a mass of electrically conductive plastic or elastomer material into a suitable fabric tape, web or mat having electrically conductive leads therein to achieve a substantial integration with the tape, web or mat whereby a conduction approaching homogenity is achieved between the mass of material and the tape, web or mat.

A disadvantage of said known heating elements is that the fabrication thereof is cumbersome, takes much time and is expensive because special apparatus is necessary for molding under pressure and heat the mass of electrically conductive plastic or elastomer material and for curing said molded structure.

From such an electric heating fabric tape or web heating pieces forming electric heating elements may be cut so as all to have the same dimensions and consequently the same heating capacity.

However a very serious disadvantage of such an electric heating tape of fabric is that when heating elements having different heating capacities must be manufactured of the same tape or web this can only be achieved by increasing or decreasing their dimensions (length). When increasing their dimensions in order to have more heating capacity the disadvantage arises that they are too cumbersome so that they cannot be mounted in the apparatus for which they are destined. When decreasing their dimensions, if less heating capacity is necessary, the disadvantage may arise that they are too small to equally heat the surface of the object to be heated.

According to the method of manufacturing heating elements, by cutting pieces from an electric heating fabric in the shape of a tape or web, which have properties which are different one from another it is necessary to vary the size of mesh and filaments comprising the fabric tape or web, as well employing conductive elastomers whose electrical properties are different from one another so that for each type of element to have a predetermined surface area and a predetermined heating capacity a special fabric heating tape or web must be manufactured. In consequence thereof a large number of different electric heating tapes or wires must be kept in stock.

It is a general object of the present invention to provide an electric heating fabric which has the surprising advantage that pieces having one and the same surface area may be cut therefrom to form electric heating elements the heating capacity of which may be controllably varied in a very simple way within broad limits which are defined by the resistance of said elements, in the case that the strips of said elements containing electric heating wires are all connected in parallel and all connected in series respectively. As a consequence thereof, electric heating elements having a predetermined surface and a predetermined heating capacity as well as heating elements having a predetermined surface and a different predetermined heating capacity may be cut from one and the same electric heating fabric.

Electric power will be converted 100% into heating power in conductive material connected to an electric current source. The numerical relationship between power voltage and resistance is:

$Q=(U^2/R)$ watt, $U$=voltage, $R$=resistance in Ohm, $Q$=heating power (watt)

If the outside surface area of the element is known to be F sq. mtr., the numerical relationship between power density (watt density), heating power and F will be:

$q=(Q/F)$ W/sq. mtr., q being the density of power.

Then the thermal law of Ohm represents the numerical relationship between density of power (q), temperature rise ($\Delta t$) and the thermal resistance value of the environment ($R_{th}$), being:

$\Delta t = q \times R_{th}$ (°C.) · $R_{th}$ is expressed in $\frac{\text{sq. mtr. °C.}}{W}$ units of thermal resistance.

Then the heating temperature t of the entire area can be controlled, by one sensor and a power control device.

It is of importance to know that this law does not give the required information to be made comparable to the area to be heated, for heat to be transferred by convection. In this case the "driving force" for transferring heat is $(t_1 - t_2)$, the difference of the temperature of the heater and the air (water), and is not accurately known, while heating. "Generated power" on the other hand gives rise to the temperature rise ($\Delta t$) and its density of power can be accurately calculated, measured and controlled.

SUMMARY OF THE INVENTION

Briefly, the objects of the invention are achieved by an electric heating fabric, having opposed selvedges, which comprises electrically conductive lead wires at least two of which are provided as a warp in each of said selvedges, warp threads of electrically insulating material being disposed between said selvedges, strips containing a plurality of heating weft wires of electrically conductive material woven in the fabric being arranged in parallel relation in said fabric, said strips of heating weft wires alternating with strips containing a plurality of weft threads of electrically insulating material, one of the ends of said heating weft wires being in electrical contact with the lead wires of one of said selvedges and the other of said ends being in electrical contact with the lead wires of the other one of said selvedges.

According to the invention the weft threads of electrically insulating material and the warp threads of electrically insulating material may be of a thermally good conductive material.

Said thermally good conductive material may be boron nitride.

BRIEF DESCRIPTION OF THE DRAWINGS

Other objects, features and advantages of the invention will become apparent, and its conduction and operation better understood from the following detailed description in conjunction with the accompanying drawings in which by way of example two embodiments of the electric heating fabric according to the invention are shown diagrammatically. For the sake of clarity the electrically insulating warp and weft threads are indicated in this drawing by dash lines and the warp and weft threads composed of electrically conductive material are denoted by thicker, fully drawn lines.

In the drawings.

DESCRIPTION OF THE PREFERRED EMBODIMENTS

Figure 1:
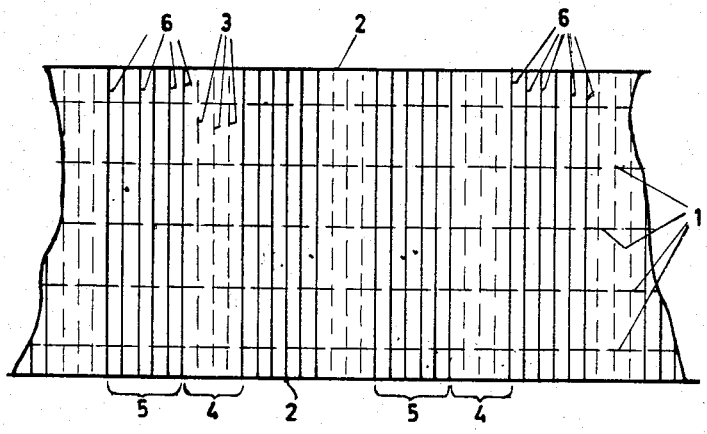
FIGS. 1 and 2 each show a top plan view of a portion of the fabric.

The electric heating fabric shown in FIG. 1 consists of warp threads 1, of electrically insulating textile material, consisting of plastic, artificial silk or other weaving threads of prior art, which material is selected according to the purpose for which the fabric is intended. An electrically insulating material that can advantageously be used is boron nitride, from which thin threads are made. Boron nitride threads not only have good electrical insulation qualities but are also good heat conductors, as a result of which the entire surface of the fabric acquires an equable or substantially equable temperature so that it can emit heat uniformly over its entire surface.

The warp threads 1 are positioned between two groups 2 of the thin electrically conductive wires extending along the longitudinal borders or selvedges of the fabric over its entire length to which wires the current feed wires may be connected. The material to be used for said current feed wires may, for instance, be copper.

The fabric further consists of weft threads 3 of electrically insulating material, which may be the same material as is used for the insulating warp threads. The weft threads are placed in strips 4 of the fabric which are spaced a certain distance from each other. Situated between these strips 4 are strips 5, which are composed of a plurality of thin, bare weft threads consisting of electrically conductive material. These weft threads have a thickness which is preferably equal to or less than 0.05 mm. The material to be used for said weft threads may, for instance, be bare stainless steel or other conductive material. Though being woven, said thin weft threads 6 make a good electrical contact with the wires in groups 2 which consist of electrically conductive material.

When these groups of wire 2 are connected to a source of electric current, all the strips 5 are electrically connected in parallel. By removing portions of the thread groups 2 which form the margin of the strips 4 of electrically insulating material, any desired series-parallel connection or series connection of the strips 5 can be achieved, so that the heating capacity of the electric heating fabric may be controllably varied between the limits defined by said two electrical connections. Thanks to this possibility, the fabric can be manufactured as a mass product and be made suitable for a great diversity of applications requiring a very low or very high heat production per unit or surface area at a given voltage, and be adapted to existing safety regulations, for instance that the required heat production must be delivered at a "safe" voltage, e.g 42 V.

Due to the fact that the electrical resistance of the fabric may be controllably varied between the limits defined by the connection of the strips of electrically conducting wires in series and the connection of said strips in parallel the advantage is obtained not only that elements may be obtained with a predetermined surface and a predetermined heating capacity, but that heating elements having a predetermined surface and a different predetermined heating capacity may be obtained by cutting of pieces of one and the same electric heating fabric and it is also possible to vary the voltage of the electric feeding source of said elements between broad limits without changing the heating capacity of said elements, as it is only necessary to vary the series-parallel connection of the electrically conductive wire strips thereof.

Figure 2:
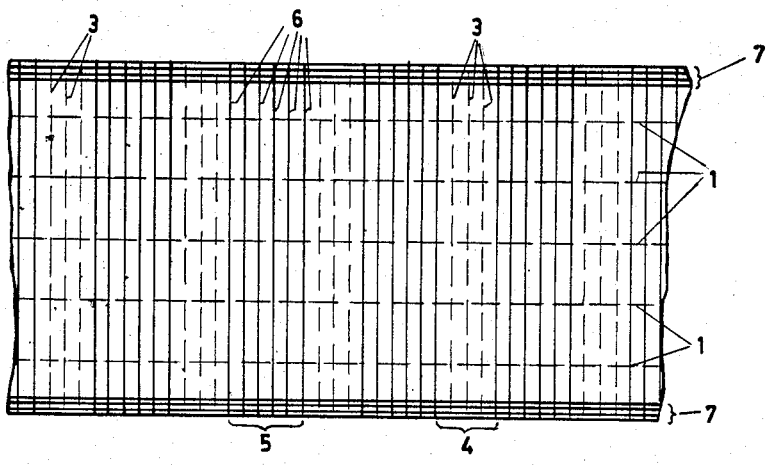

The fabric shown in FIG. 2 differs from that of FIG. 1 in that the wire groups 2 are replaced by a plurality of warp threads 7 situated in the selvedge edges of the fabric, which warp threads consist of electrically conductive material. Said warp threads are interwoven with the weft threads so that a particularly good and durable contact is established between said electrically conductive warp threads 7 and the electrically conductive weft threads 6. The electrically conductive threads 7 are situated in the selvedges of the fabric and, as in the case of the fabric according to FIG. 1, may be locally removed, e.g. by cutting, as a result of which any desired scheme of connection of the strips of electrically conductive weft threads 6, can be obtained.

The electrically conductive weft threads may, by the application of known weaving techniques, be mixed in with insulating threads on weaving looms of prior art. The fabric may also be covered with plastic on one or both of its surfaces, for instance by impregnating or coating. Said surfaces may also be covered with a protective fabric such as glass cloth, which can be stuck to the fabric with the aid of a synthetic resin, by heating or by some other method known per se. Suitable methods for this purpose are commonly known in the art. Carbon filaments may be used to compose the electrically conductive weft threads 6 and their high resistance is no drawback in view of the freely selectable size of thread, number of threads per strip 5 and the series-parallel connection.

Carbon threads may also be used as electrically conductive filaments in the selvedges.

By way of further elucidation of the invention, some typical embodiments of the fabric according to the invention are described below.

EMBODIMENT I

A fabric was manufactured having a compactness equal to that of 6000 of the warp threads consisting of electrically insulating threads of artificial silk (rayon) with a titre of 120 denier over a width of 152 cm. The said warp threads consisted of 50 elementary filaments.

The compactness of the electrically conductive selvedge warp threads 7 amounted to 90 threads over a width of 2 cm. The selvedge warp threads consisted of four intertwined elementary filament of stainless steel No. 4301 (American type designation 304), titre 154 dTex.

The weft threads consisting of electrically insulating material were applied with a compactness of 10 threads over a width of 5 mm, using nylon 134 dTex with 20 elementary filaments.

The compactness of the electrically conductive threads was 30 threads over a width of 1 cm, using stainless steel monofilar steel weft wires No. 4301, likewise 154 dTex.

EMBODIMENT II

A fabric was manufactured of 900 electrically insulating warp threads over a width of 45 cm. These warp threads consisted of nylon 72 dTex and had 14 elementary filaments.

The compactness of the said warp threads of electrically conductive material as 2 thread groups per 2 mm, using copper threads of 17500 dTex having 100 elementary filaments.

The compactness of the weft threads of electrically insulating material was 3 threads over a width of 5 mm. The weft threads were composed of nylon 1000 dTex and had 336 elementary filaments.

The compactness of the weft threads of electrically conductive material was 30 threads over a width of 1 cm. Said weft threads consisted of monofilar stainless steel filaments No. 4301 135 dTex.

The fabric may have on one of its surfaces a covering that will reflect heat rays, such as polished aluminium, so that the fabric can emit heat rays only towards the side that is averted from this covering. Instead of using filaments according to groups 2 of electrically conductive wires groups 2 of insulating filaments coated with electrically conductive material may be used which is applied by any desired method known per se.

I claim

1. An electrical heating fabric comprising warp strands and weft strands, two opposed selvedges being formed by interweaving said warp and weft strands, electrically conductive lead wires being provided as a warp in each of said selvedges, warp threads of electrically insulating material being disposed between said selvedges, the weft strands comprising separate spaced groups of thin threads of electrically insulating material and separate spaced groups of thin wires of electrically conductive material, respectively, said groups of weft threads and said groups of weft wires being arranged in alternating parallel first and second groups, each of which first groups contains a plurality of thin parallel threads of electrically insulating material extending directly between the selvedges, each of which second groups contains a plurality of discrete thin wire strands of electrically conductive material extending in straight parallel lines directly between the selvedges, one of the ends of each individual one of the weft wire strands of each of the groups of electrically conductive material being in electrical contact with the lead wires of one of the selvedges and in electrical contact with the lead wires of the other of said selvedges, whereby, for a fabric of predetermined dimensions, various amounts of heat capacity may be provided by electrically disconnecting individual conductive weft strands from the lead wires in the selvedges.

2. An electrical heating fabric as claimed in claim 1 wherein said weft threads of electrically insulating material and said warp threads of electrically insulating material are of a thermally good conductive material.

3. An electrical heating fabric as set forth in claim 1 wherein predetermined ones of said weft wires of electrically conductive material are disconnected from an adjacent electrically conductive lead wire in one said selvedge.

4. An electrical heating fabric as set forth in claim 3 wherein said predetermined ones of said weft wires of electrically conductive material form one of said groups of thin wires.

5. An electrical heating fabric as set forth in claim 2 wherein predetermined ones of said weft wires of electrically conductive material are disconnected from an adjacent electrically conductive lead wire in one said selvedge.

6. An electrical heating fabric as set forth in claim 5 wherein said predetermined ones of said weft wires of electrically conductive material form one of said groups of thin wires.

* * * * *